United States Patent [19]

Abondance et al.

[11] Patent Number: 4,714,267

[45] Date of Patent: Dec. 22, 1987

[54] CROSS COUNTRY SKI ASSEMBLY

[75] Inventors: Roger Abondance, Rives; Pierre Corbet, Grenoble; Francois Jodelet, Voiron; Jean-Francois Andre, Voiron, all of France

[73] Assignee: Skis Rossignol S.A., Voiron, France

[21] Appl. No.: 738,552

[22] Filed: May 28, 1985

[30] Foreign Application Priority Data

May 29, 1984 [FR] France ..... 84 08813
Feb. 19, 1985 [FR] France ..... 85 02989

[51] Int. Cl.[4] ..... A63C 9/20

[52] U.S. Cl. ..... 280/615; 280/631; 280/636

[58] Field of Search ..... 280/613, 614, 615, 631, 280/607, 635, 636, 609, 601

[56] References Cited

U.S. PATENT DOCUMENTS 4,410,199 10/1983 Eisenberg ..... 280/615
4,487,427 12/1984 Salomon ..... 280/615

FOREIGN PATENT DOCUMENTS 76857 7/1918 Fed. Rep. of Germany ..... 280/618
53894 4/1934 Norway ..... 280/635

*Primary Examiner*—John J. Love
*Assistant Examiner*—Richard Camby
*Attorney, Agent, or Firm*—Karl F. Ross; Herbert Dubno

[57] ABSTRACT

A cross country ski assembly in which the ski has a trapezoidal ridge over at least the greater part of its length over which the longitudinal groove in the sole of a ski-boot casing can fit. The ski-boot casing is articulated to the ski directly or indirectly via a pivot axis located below the upper surface of the ridge.

23 Claims, 12 Drawing Figures

CROSS COUNTRY SKI ASSEMBLY

FIELD OF THE INVENTION

Our present invention relates to a cross country ski assembly and, more particularly, to a cross country ski-and-boot assembly which affords greater stability and reduced friction in cross country skiing while enabling the skier to take advantage of new techniques in ski propulsion, for example, the skating-like maneuvers recently developed for improved propulsion.

BACKGROUND OF THE INVENTION

It is known, in cross country skiing, to provide a pivot between the ski boot (this term being used to signify the footwear unit which is affixed to the ski) as well as means for orienting this ski boot rearwardly of the pivot to the ski.

In cross country skiing, the lateral flanks of the ski are usually quite pronounced so that the friction on the lateral flanks may represent a major part of the frictional retardation which is applied to the ski and which must be overcome by the skier.

A stable connection between the ski boot and the ski is required, moreover, for certain newly developed maneuvers in cross country skiing, including the skating-like maneuvers or half-step skating-like propulsion actions which have been proposed to more efficiently advance progress by the cross country skier over the snow.

OBJECTS OF THE INVENTION

The principal object of our present invention is to provide an improved ski assembly for cross country skiing and, more specifically, a ski-and-boot assembly which will facilitate the specific maneuvers described and in general provide a more stable relationship between boot and ski.

Another object of our invention is to provide an improved cross country ski assembly which will be comparatively low cost and nevertheless will afford reduced frictional retardation between the ski and the snow.

It is also an object of this invention to provide an improved ski and ski-boot assembly which will allow the skier to apply enhanced lateral forces in a controlled manner to the ski.

In the most general terms, moreover, it is an object of the invention to overcome disadvantages of prior art cross country skis and afford not only improved control of the ski, but increased stability in use and numerous other advantages which will be detailed below.

SUMMARY OF THE INVENTION

These objects and others which will become apparent hereinafter are attained, in accordance with the present invention by providing a ski assembly which comprises a cross country ski formed over at least the greater portion of its length from the forward tip (spoon) to the rearmost end (heel) of the ski with a longitudinal ridge along its upper surface, this ridge being connected by a pair of downwardly and outwardly extending flanks to a pair of ledges which delimit the edges of the ski so that the height of these longitudinal edges is substantially less than the overall height of the ski measured from the bottom or sole of the ski to the top of the ridge.

In this manner we are able to significantly reduce the friction between the ski and the snow along the lateral cheeks of the ski since these cheeks are formed only by the reduced-height longitudinal edges which extend from the bottom of the ski to the aforementioned ledges.

The inclined surfaces which delimit the ridge together with the upper surface not only provide purchase for the ski boot in an improved manner, but allow the ski boot to apply forces laterally to the ski in a manner which has not been possible heretofore and thus enable the skier to coveniently and effectively engage in modern half-step skating-like maneuvers for propulsion.

Another advantage of the ridge, especially when it extends the full length of the ski, is that it provides mechanical stability and strength to the ski. According to a feature of the invention, a ski boot or at least a casing adapted to receive the foot of the skier or article of footwear on the foot of the skier, is pivotally connected to this ridge such that the pivot axis extends perpendicular to a longitudial median plane of the ski but lies below the upper surface of the ridge. The ski boot, moreover is formed with a longitudinal groove extending substantially over the full length of the ski boot and complementary in cross section to matingly receive this ridge.

According to the invention, the pivot means between the ski boot or shoe and the ridge is designed to directly or indirectly articulate the shoe to the ski and the sole of the shoe or boot has a longitudinal groove which complementarily receives the ridge.

Because the interaction point between the boot or shoe in the system of the invention can lie below the upper surface of the ski, the stable interaction between the ski and the boot is such as to permit direct tracking with extraordinarily high efficiency and comfort.

The two inclined lateral faces or flanks of the ridge which contact corresponding flanks or faces of the groove in the sole of the boot, promote transfer of lateral forces and hence permit use of the lateral displacement technique in turning or in the use of the snowplow maneuver, in both of which the bottom of the ski is turned into the snow as the skier advances. Of perhaps greater importance is the fact that the lateral interaction of the boot and the ski permits a ski to be turned practically on edge for a skating-like propulsion meaneuver of the half-step type.

When a direct articulation is provided between the ski boot and the ski, the ridge of the ski is formed with a sleeve or sheath extending transversely to the ridge and parallel to the plane of its upper surface, this sleeve extending the full thickness of the ridge. The sole of the boot or shoe is formed on opposite sides of its longitudinal groove with holes aligned with each other and alignable with the sheath so that a hinge pin can be inserted through these holes and the sheath and retained against movement in its axial direction or in a direction transverse to the ridge. As noted, means is provided for retaining the pivot pin or pintle or the other means defining this pivot axis against movement with respect to the boot.

According to an alternative embodiment of the invention, the articulation between the boot and the ski is formed by a pair of cylindrical lugs carried by the ski and on opposite sides of the groove, the sole of the boot is formed with two recesses or receptacles each adapted to receive one of the lugs and defining the pivot axis therewith. In both cases, the sole of the boot can be fixed to the ski at a pivot axis located below the surface of the ridge and can be substantially permanently attached thereto.

An indirect articulation of the boot and the ski can be provided utilizing a stirrup adapted to receive the boot and having a pair of arms which straddle the longitudinal ridge of the ski and connected by a pivot axis transversely of this ridge. The portion of the stirrup which lies below the boot can conform to the shape of the ridge and means is provided for locking the stirrup to the ridge so that the pivot axis is defined below the surface of the ridge. Means can be provided for releasably retaining at least the front end of the boot, e.g. the toe thereof in the stirrup.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
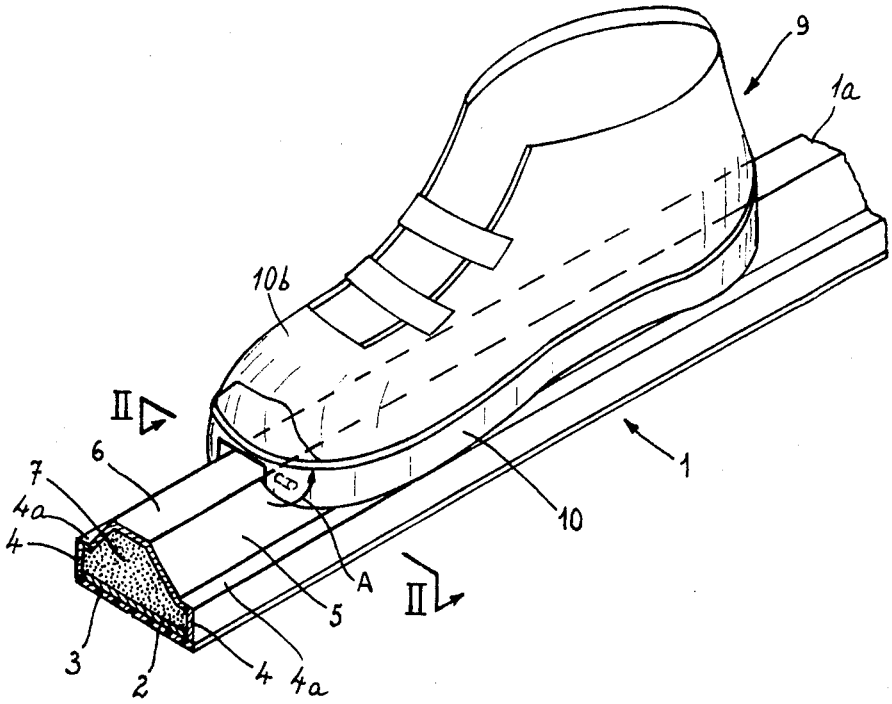
FIG. 1 is a diagrammatic perspective view showing the shell of a ski boot pivotally connected to the ski at a fixed articulation according to the invention.
Figure 2:
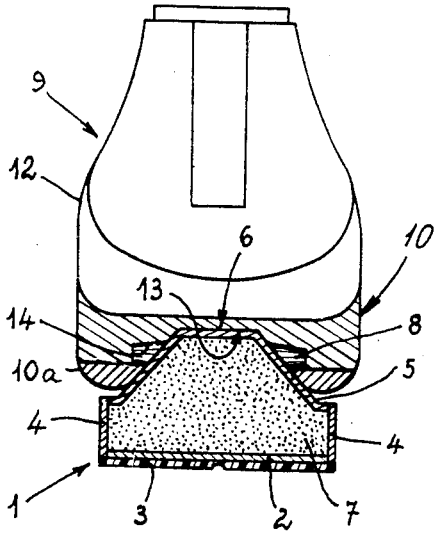
FIG. 2 is a transverse section through the boot and ski of FIG. 1 drawn to a larger scale.
Figure 3:
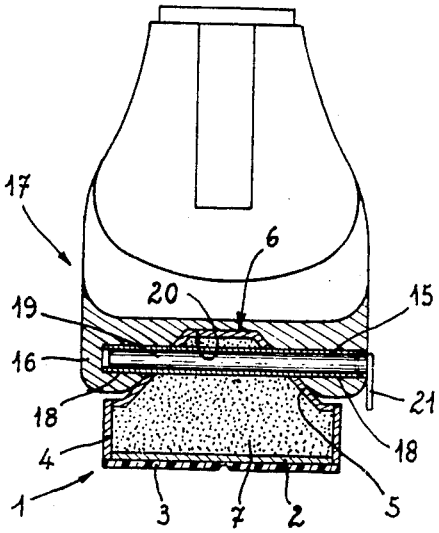
FIG. 3 is a section similar to FIG. 2 showing another direct articulation between the boot and the ski but with the facility of enabling separation of the boot from the ski.

FIGS. 1–3 show two embodiments of the invention in which a sole 10 of a ski boot 9 forms a direct articulation with the ski 1.

The ski 1 has a lower surface 2 which is lined with a low-friction sliding layer 3. The ski 1 also has a pair of longitudinal edges defined by lateral cheeks 4 whose heights are reduced significantly to terminate at horizontal ledges **4*a* from which a ridge 1*a* rises. This ridge is defined by a pair of downwardly and outwardly (or upwardly and inwardly) inclined flanks 5, hereinafter sometimes referred to as oblique faces, and a horizontal upper surface 6 which is parallel to the underside 2 of the ski. The members 2, 4 4*a*, 5, 6 define a hollow receiving the core 7** of the ski. The core can be an assembly of parts or a foamed synthetic resin such as polyurethane.

The body of the ski can be formed as can be seen from FIG. 2, by a pair of coaxial lugs 8 disposed transversely of the longitudinal median plane through the ski and perpendicular to the surfaces 2 and 6 and coaxially with one another. These lugs 8 can be received in recesses 14 forming seats molded into the sole 10 of the boot and these recesses can in part be closed by members **1O*a* which can be bolted onto the boot from below. The lugs 8 here form a direct and definitive articulation for the boot 9. In the embodiment shown in FIG. 7 the boot 9** is in the form of a casing in which some other footwear of the skier, e.g. a heavy sock, a boot liner or the like can be inserted.

In other words, member 9 in FIG. 1 while only the outer casing of a boot or shoe represents the footwear worn by the skier and anchored to the ski. The term "boot" will be used herein to refer to such footwear although it will be understood to represent any conventional cross country ski shoe, boot or other footwear whether of the rigid or flexible type and whether intended to be used with a liner or not.

The body comprises, as noted, the sole 10 and an upper **1O*b* attached to this sole. The shank 12** of the upper is of the low type and the upper can receive a light shoe or heavy sock and can be equipped with means such as straps, buckles or laces for holding it in place, but in the preferred and best mode form of the invention, two part footwear will be used, including a casing which is affixed permanently to the ski or is releasably affixed to the ski and an inner member, e.g. a liner which is removable from the outer member.

The sole 10 of the casing 9 comprises over its entire length a groove 13 whose profile (cross section) and dimensions correspond to those of the ridge **1*a* which is formed over the entire length of the ski by the oblique faces 5 and the upper surface 6** of the ski boot.

Within the sole there are formed the coaxial seats 14 whose profile and dimensions correspond to those of the lugs 8 and enable the boot to pivot about a transverse axis through these lugs and hence through the ridge below the surface 6 of the ski.

After the casing 9 has been fitted onto the ski, a direct pivotal action of the boot upwardly as represented by the arrow A about the axis of the lugs is permissible.

Once the pieces **10*a*** are fixed in place, simple removal of the boot is not possible.

Another direct connection can be provided in accordance with FIG. 3 and the embodiment there shown, although here the boot can be disconnected from the ski.

Below the surface 6 of the ridge of the ski shown in FIG. 3, a cylindrical sleeve 15 is fitted transversely of the ridge and extends entirely through the ridge to terminate flush with the oblique faces 5 thereof. Two symmetrical passages 18 are formed in the sole 16 of the boot 17 and these passges can be coaxial with the sleeve when the boot is in position on the ski as shown in FIG. 3. The pivotal motion described in FIG. 1 is here also permitted by the recess (e.g. **13*a***) forming a clearance immediately forwardly of the pivot axis between the front of the boot and the ridge.

The boot is connected to the ski by a pintle 19 introduced through the opening at one of the lateral faces of the sole 16 and traversing the two passages 18 while, in addition passing through the sleeve 19. The sole 16 has a longitudinal groove into which the two passages 18 open. Consequently, the pintle 19 defines a horizontal pivot axis connecting the boot to the ski. Any desired means can hold the pintle in place and such means can include, for example, a cotter pin, detent means or the like. A free end of the pintle is provided with a lug 21 which can be engaged by the fingers of the user to enable extraction of the pintle should it be desirable to change the boot.

One of the passages 18 is closed outwardly. A notch in the opposite lateral wall of the sole may be provided to receive the lug 21.

Figure 5:
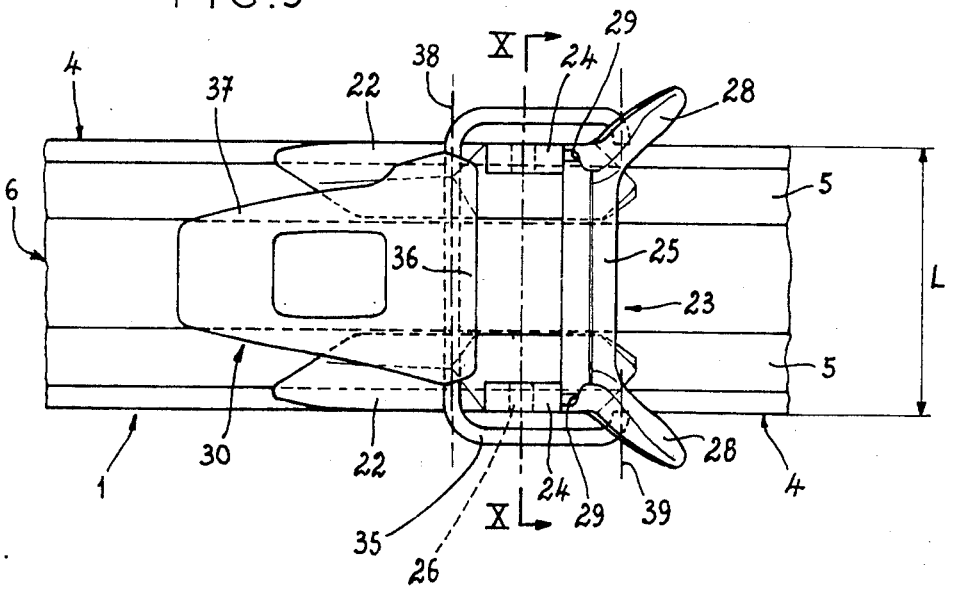
FIG. 5 is a top plan view of the attachment device of the embodiment of FIG. 4, seen from above.
Figure 6:
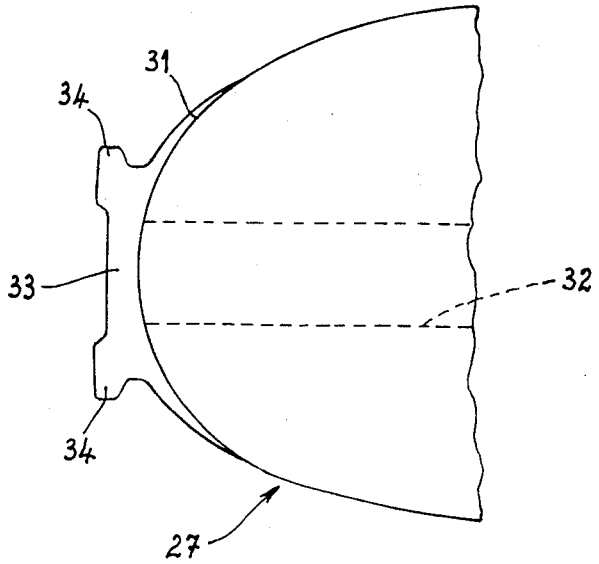
FIG. 6 is a plan view from above showing the toe of the boot.
Figure 7:
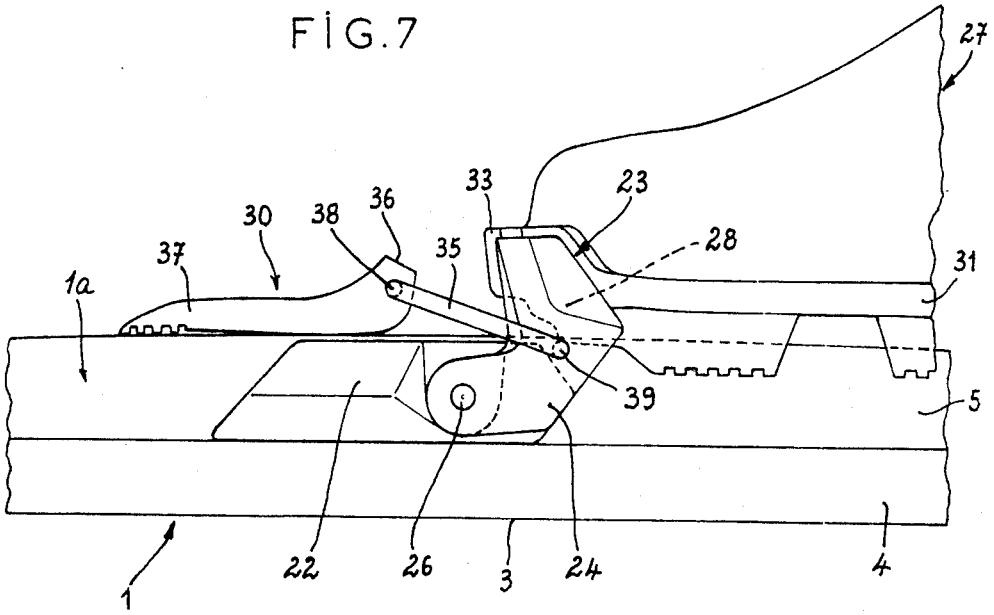
FIG. 7 is a side view of the coupling region between the boot and the ski showing the position of the stirrup before locking of the boot to the ski.
Figure 8:
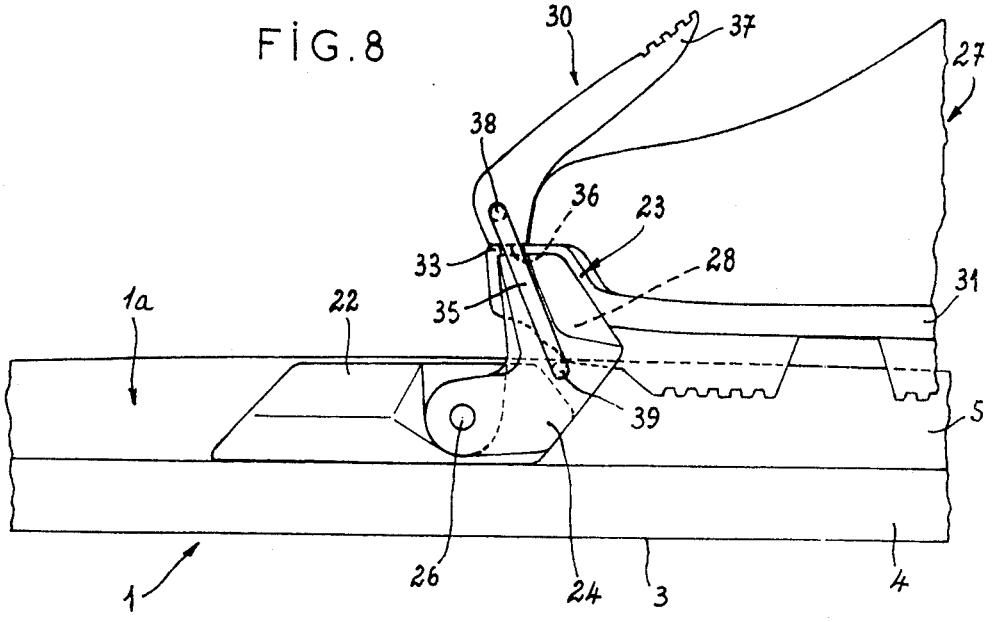
FIG. 8 is a view similar to FIG. 7 but showing the boot or show in its locked position.
Figure 9:
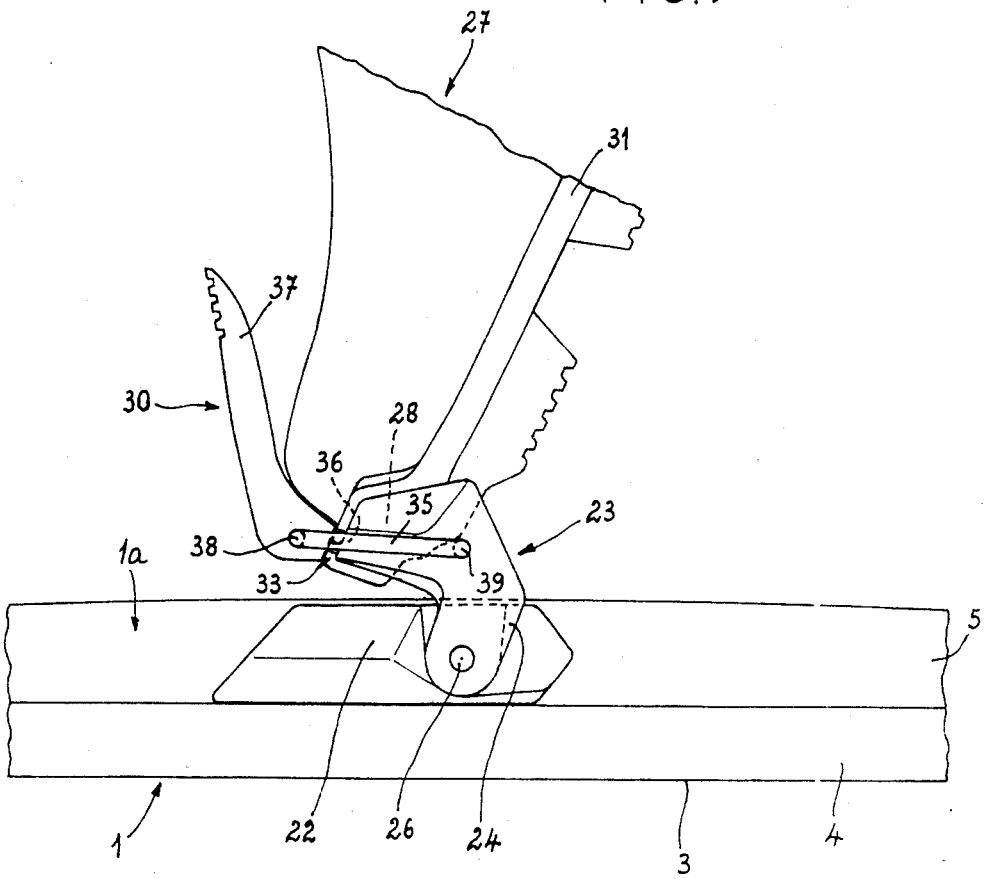
FIG. 9 is a view similar to FIGS. 7 and 8 but wherein the boot is seen pivoted upwardly with respect to the ski.

FIGS. 4–12 illustrate another embodiment of the invention in which the boot is pivotally connected indirectly to the ski 4. In this case an intermediate piece is employed in the form of a pivotal stirrup 23 having a pair of lateral arms 24 interconnected by a traverse or connecting bar 25. The two arms 24 straddle the longitudal ridge 1*a* of the ski 1 and each has a bent configuration of generally L shape as best seen in FIGS. 7 and 9. The traverse 25 lies above the ridge 1*a* of the ski 1.

The stirrup 23 is mounted so that it can pivot about a horizontal axis transverse to the longitudinal vertical median plane of the ski 1, this axis being defined by a pin 26 which traverses the ridge 1*a* below the surface 6 and is fixed to the lower ends of the two arms 24. The pin 26 is mounted so that it is free to rotate in two symmetrical bearing plates 22 or journals applied to the oblique faces 5 of the ridge 1*a*. The pivot axis is located between 3 and 15 mm from a vertical plane substantially at the toe of the boot.

In the normal lowered position of the stirrup, such as can be seen from FIGS. 4–8, practically the entire stirrup is located rearwardly of the pivot shaft 26 on the ski. The two lateral arms 24 of the stirrup 23 do not extend beyond the lateral edges 4 of the ski or project only slightly therebeyond so that the width of the ski L is not significantly exceeded by the transverse length of the stirrup as measured between outermost portions of the arms 24. The upper part of the stirrup 23 is shaped to permit the releasable engagement of the toe of the boot 27 by an arrowhead assembly or latch arrangement. Any conventional toe-engaging latch utilized in cross country or other skiing may be used for this purpose or we can employ the latch mechanism shown in greater detail in FIGS. 4 and 9, for example, for this purpose.

Figure 4:
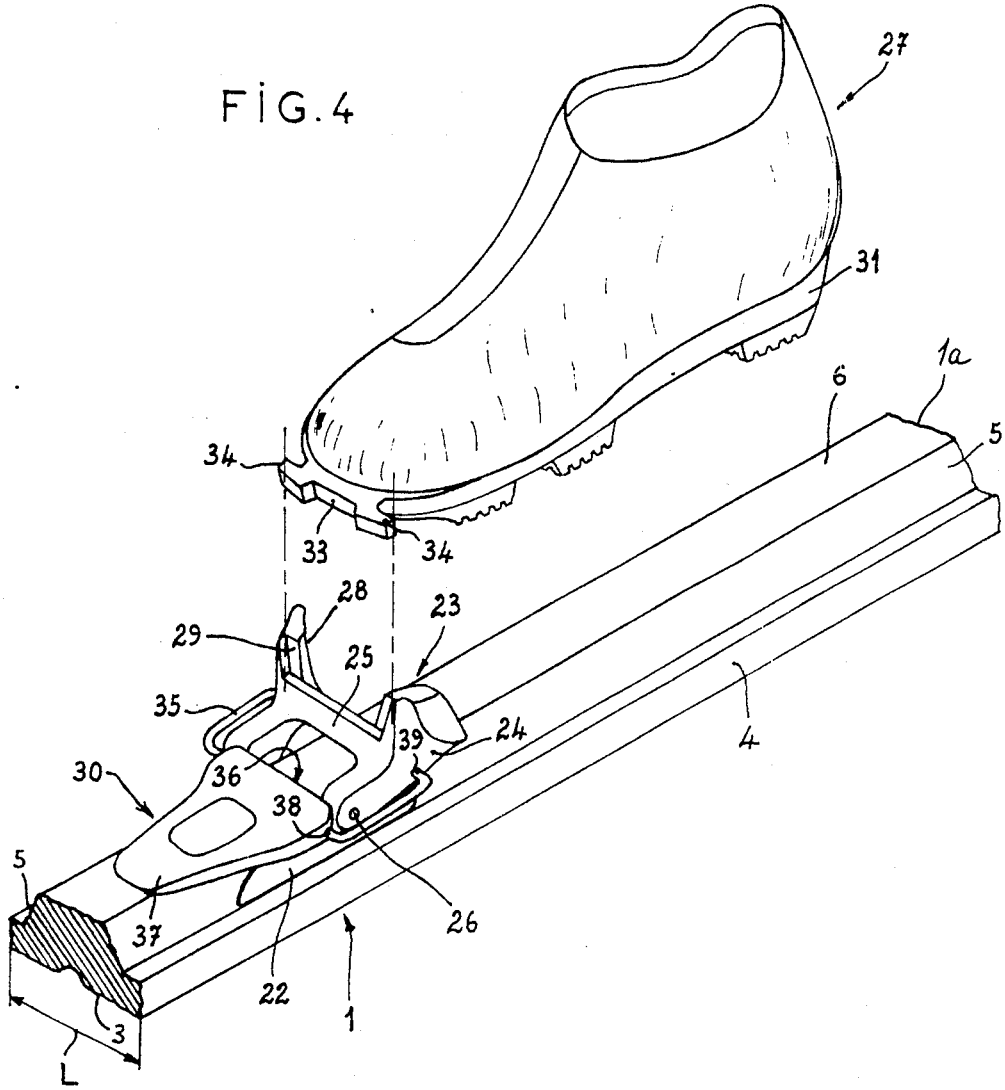
FIG. 4 is a partially exploded perspective view showing an indirect coupling of the boot to the ski and in which the boot can also be removed.

More specifically, the regions proximal to the upper ends the two lateral arms 24 of the stirrup have symmetrically inclined faces 28 turned toward the rear of the ski and two symmetrical facets 29 turned toward the front of the ski (see especially FIGS. 4 and 5).

The boot 27 has a special sole 31 which is formed with a longitudinal groove 32 conforming in shape complementarily to the continuous longitudinal ridge 1*a* extending the full length of the ski.

At the front of the boot 27, the sole 31 is extended by a T-shaped part 33 forming the arrowhead profile with two lateral protuberances 34 (see FIGS. 4 and 6). The projecting portion 33 defines a recess between the protuberances and is shaped to fit into the stirrup 23 by a substantially vertical movement in the course of which the front edges of the sole 31 come to bear against the two inclined faces 28 of the stirrup while the two protuberances 34 hook into and engage in front of the facets 29. In the course of this movement a collateral effect is obtained thanks to the slightly conical shape of the complementary parts which interfit one into the other. This effect is a wedging action.

In order to immobilize releasably the boot with respect to the stirrup, a locking lever 30 is provided, this lever being generally L shaped and being connected by an articulating element 35 in the form of a wire bail to the stirrup 23, thereby forming a toggle or deadcenter linkage therewith.

The lever 30 is formed in one piece and comprises a face 36 adapted to lock tightly against the projecting portion 33 of the sole at the front of the boot. The other main part of the lever comprises a manipulating tongue 37 which can be notched, milled or serrated to facilitate gripping by the user. The bail 35 of metal wire is pivotally connected on the one hand to the lever 30 about a transverse axis 38 located close to the locking face 36. The bail is also pivotally connected to the stirrup 23 about another axis 39 parallel to the axis 38.

An elastic connection, not shown, is provided by the bail or other means to one of the articulation axes 38 or 39 tending to draw the same toward the surface 6 of the ski. The articulation axis 39 between the intermediate element 35 and the stirrup is located in the region of the bend of the two L-shaped arms 24 of the stirrup 23.

FIGS. 4, 5 and 7 show the attachment mechanism in the open position of the lever 30 in which this lever lies substantially flat along the upper part of the ridge 1*a* and has its tongue 37 turned toward the front of the ski.

The front of the boot 27 can then be wedged into the stirrup 23 from above as previously described, the locking of the boot in place being effected by swinging the lever 30 in a clockwise sense (FIG. 4) toward the rear of the ski.

After passage through a deadpoint, the lever 30 occupies a final position which is best seen in FIG. 8, the tongue overlying the toe of the boot and the clamping face 36 of the lever bearing upon the projecting portion 33 a location which lies forwardly of the plane connecting the pivot axes 38 and 39. Because the bail 35 must be somewhat stretched in movement past the deadcenter position and in the clamping action, the locking mechanism is retained strongly in this position.

When the boot is locked in place (FIG. 8) the entire locking mechanism and the stirrup 24 can nevertheless be pivoted from the position in which its lower branches of the arms 24 are horizontal (FIG. 8) in the counterclockwise sense (FIGS. 8 and 9) into a position in which these lower branches have been swung through, say, 70° upwardly.

It may be noted that the pivot axis 26 of the stirrup is located below the surface 6 of the ridge 1*a* substantially at the forward end of the boot so that there is no obstruction on the ski in front of the toe of the boot and the stirrup.

Figure 10:
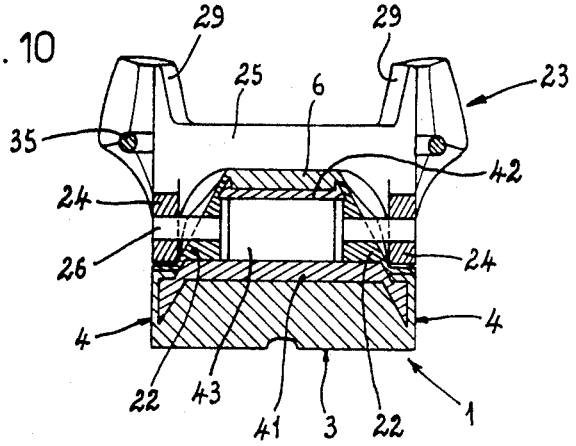
FIG. 10 is a section taken along the line X—X of FIG. 5.
Figure 11:
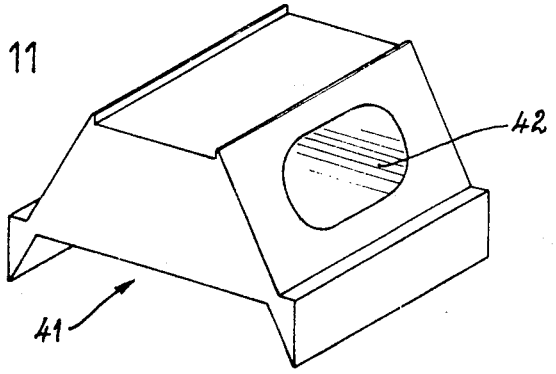
FIG. 11 is a perspective view of an insert adapted to be received in the ski.
Figure 12:
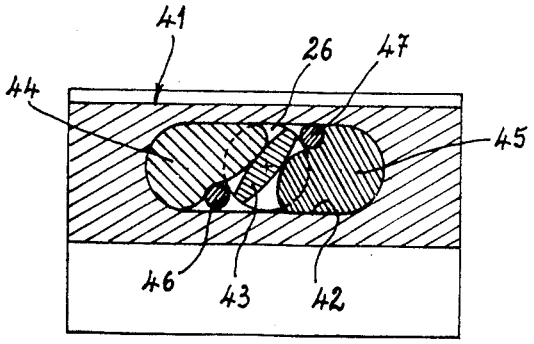
FIG. 12 is a section through the insert and the elements therethrough showing the means for anchoring the pivot for the stirrup constituting an indirect connector of the boot to the ski.

In FIGS. 10–12 we have shown a retainer for the pivot 26 of the stirrup which elastically resists the free pivotal movement thereof illustrated in FIGS. 8 and 9 with progressively increasing forces.

A rigid insert 41 of generally trapezoidal prismatic profile and hence of a cross section substantially the same as that of the ridge 1*a* is embedded in the body of the ski. The configuration of this insert is best seen in FIG. 11. The insert is formed from side to side with a transverse passage 42 of oblong cross section. The passage 42 is traversed by the pivot axis 26 of the stirrup 23. Between its cylindrical ends in which the pivot axis or shaft 26 can rotate in the two lateral journal plates 22, it has a flattened median zone 43 forming a sort of plate whose cross section is best seen in FIG. 12.

As is apparent from FIG. L2, two blocks of compressible elastic material represented at 44 and 45 are received in the passsge 42 to flank the plate 43 of the shaft 26. The elastic blocks 44 and 45 are held in place by a pair of fingers 46 and 47 which are fixed in the insert 4' and press against two opposite faces of the flattened part 43 of the shaft 26.

The blocks 44 and 45 thus assure not only a return of the stirrup 23 toward its position seen in FIG. 8 but also serve to retain the stirrup when it approaches its upwardly tilted position with progressively increasing elastic force. The blocks can be constituted by an elastomer, can be perforated, cellular or otherwise modified to obtain the desired elastic effect and can be fixed, if desired, e.g. by vulcanization to the shaft 26 on the one hand and to the insert 41 on the other.

They can, however, also be replaceable to control the resilient bias upon the stirrup, e.g. via perforation or by modification of other properties thereof.

We claim:

1. A cross-country ski assembly, comprising:

a cross-country ski constituted of a ski body formed with:

a bottom surface for engagement with snow, a ridge unitary with said body and extending over substantially the entire length of the ski and over a major portion of the width thereof and defining the top of the ski, and a pair of longitudinal flanks laterally bounding the ski while extending upwardly from said bottom surface to substantially the level of a bottom of said ridge, said ridge comprising:

an upper surface substantially parallel to said bottom surface, and a pair of oblique faces diverging downwardly and outwardly from said upper surface to the bottom of said ridge;

a boot member adapted to receive a foot of a skier and having a sole formed with a longitudinal groove extending continuously from a toe to the heel of said boot member and complementary in shape to that of said ridge and adapted to rest upon said ridge over the entire length of said sole; and means at a front end of said member defining a pivot axis coupling said member to said ski body, said pivot axis extending through said ridge transversely of said ridge below said upper surface and above said bottom of said ridge and said longitudinal flanks.

2. The assembly defined in claim 1 wherein said means defining said pivot axis comprises a transverse sleeve extending through the thickness of said ridge, said member having a sole formed with said groove and provided with a pair of coaxial passages aligned with said sleeve, and a pintle extending through said coaxial passages and said sleeve.

3. The assembly defined in claim 2, further comprising means for fixing said pintle to said member.

4. The assembly defined in claim 1 wherein said means defining said pivot axis comprises two substantially cylindrical lugs projecting from opposite sides of said ridge and received in respective seats in a sole of said member on opposite sides of said groove.

5. The assembly defined in claim 1 wherein said means defining said pivot axis comprises a stirrup having two arms straddling said ridge and connected by a transverse, said arms being pivotally mounted on said ski about said pivot axis, said stirrup being shaped to receive a complementary projecting portion of said member at a toe thereof and locking means for retaining said projecting portion in said stirrup.

6. The assembly defined in claim 5 wherein said arms are generally L shaped and said stirrup is predominently disposed rearwardly of said axis with respect to said ski in a position of said member flat against said ski.

7. The assembly defined in claim 5 wherein said stirrup is shaped so that at least a lowermost portion thereof does not project significantly beyond the width of said ski.

8. The assembly defined in claim 5, further comprising elastic means for progressively resisting displacement of said stirrup about said axis.

9. The assembly defined in claim 8 wherein said elastic means includes an elastic member acting upon a pivot shaft pivotally connecting said stirrup to said ski.

10. The assembly defined in claim 9 wherein said shaft has a flattened portion and said elastic means includes two blocks of elastically compressible material received in said ridge and bearing on opposite sides of said flattened portion.

11. The assembly defined in claim 10 wherein said shaft is formed with cylindrical ends journaled in respective bearing plates along opposite flanks of said ridge and said flattened portion and said blocks are received in an oblong transverse passage of an insert received in said ski.

12. The assembly defined in claim 8 wherein said elastic means includes a resilient spring element disposed below said upper surface of said ski.

13. The assembly defined in claim 5 wherein said locking means includes an arrowhead assembly formed by a rib of each arm of said stirrup and a corresponding groove adapted to receive a respective rib laterally of the projecting portion of said member.

14. The assembly defined in claim 13 wherein said arms are formed with inclined lateral faces and facets for engaging said projecting portion at least in zones proximal to upper ends of said arms.

15. The assembly defined in claim 5 wherein said stirrup and said projecting portion have slightly conical mating configurations enabling a wedging interaction of said projecting portion and said stirrup.

16. The assembly defined in claim 5 wherein said locking means includes a locking lever articulated by a wire bail to said stirrup and adapted to clamp said projecting portion against said stirrup when said lever is swung toward said member.

17. The assembly defined in claim 16 wherein an articulation between said bail and said stirrup is formed in the region of the bends of said arms where said arms are generally L shaped.

18. The assembly defined in claim 12 wherein said axis is located substantially at the front end of said member.

19. The assembly defined in claim 12 wherein said member is a ski-boot casing adapted to receive a liner on the foot of the skier.

20. The assembly defined in claim 12 wherein said ridge is of generally trapezoidal cross section and is connected with said flanks by a pair of ledges parallel to an upper surface.

21. The cross-country ski assembly defined in claim 1 wherein said pivot axis has a length such that at least along one lateral side of the ski it does not project outwardly of the longitudinal flank.

22. The cross-country ski assembly defined in claim 21 wherein said axis projects outwardly beyond the other lateral flank of the ski.

23. The cross-country ski assembly defined in claim 21 wherein said axis is dimensioned such that it does not project laterally beyond the other lateral flank of the ski.

* * * * *